United States Patent [19]

Balbinot

[11] 4,449,274

[45] May 22, 1984

[54] DEVICE FOR CONTROLLING THE FITTING-ON OF SKI BOOTS AND THE LIKE

[75] Inventor: Renzo Balbinot, Vittorio Veneto, Italy

[73] Assignee: Nordica S.p.A., Montebelluna, Italy

[21] Appl. No.: 340,947

[22] Filed: Jan. 20, 1982

[30] Foreign Application Priority Data

Jan. 28, 1981 [IT] Italy ..... 19382 A/81

[51] Int. Cl.[3] ..... A43B 11/00; A43B 5/04; A43C 11/00

[52] U.S. Cl. ..... 24/70 SK; 24/68 SK; 24/68 A; 36/50; 36/117

[58] Field of Search ..... 24/68 SK, 69 ST, 69 SK, 24/70 SK, 70 ST, 132 WL, DIG. 22, 68 BT, 68 A, 206 R, 270, 271, 272, 273; 36/117, 119, 120, 50; 280/611

[56] References Cited

U.S. PATENT DOCUMENTS 4,190,970 3/1980 Annovi ..... 36/50

FOREIGN PATENT DOCUMENTS 2005481 12/1969 France ..... 24/68 SK
2448872 10/1980 France ..... 36/117

*Primary Examiner*—Robert Peshock
*Assistant Examiner*—John G. Weiss
*Attorney, Agent, or Firm*—Guido Modiano; Albert Josif

[57] ABSTRACT

The device comprises a pressure band engageable with the front upper portion of an inner shoe attached with one end to a side area of the boot, whereas the other end thereof is connected to a tension band, effective to be operated by a skiing stick. On the tension band there acts a releasable lock serrated portion adapted to allow the free translatory movement of the tension band in one direction and to prevent the translation of the tension band in the opposite direction. Tension on the tension band causes compression of the inner shoe by the pressure band against the user's foot.

5 Claims, 5 Drawing Figures

DEVICE FOR CONTROLLING THE FITTING-ON OF SKI BOOTS AND THE LIKE

BACKGROUND OF THE INVENTION

This invention relates to a device for controlling the fitting-on or fit of ski boots and the like.

As is known, a currently much felt problem in the ski boot industry is that of enabling the boot fit to be adjusted as desired while maintaining a secure locking action on the skier's foot, and this without exerting any anomalous pressures which may result in the user discomfort.

In order to solve such a problem, various devices have been proposed which are based upon a whole range of construction criteria; among these, a device is worth mentioning which comprises a band element attached with one end to the inside side portion of a boot and so arranged as to span the front upper area of the foot.

Said band element can be manually pulled at its other end such as to compress the foot thereunder and lock it in position.

This embodiment, while useful from a theoretical standpoint, has proved relatively impractical from the functional standpoint because the user is required to apply the tension manually and manually perform the locking of the band element, which is not readily feasible, specially on account of the environmental conditions wherein the operation is to be carried to completion.

SUMMARY OF THE INVENTION

The primary object of this invention is, in fact, that of solving the above problem by providing a fit control device which has a band spanning the front upper area of the foot, can be operated by the user in a most convenient manner, and is very simple to adjust.

A further object of the invention is to provide a device which can be operated by the user while in a virtually standing position, both during the locking phase, hereinafter called closure, and during the releasing phase, hereinafter called opening.

Another object of this invention is to provide a device wherein the locking in the desired position can be effected in a practically automatic manner, during the closure phase, thus affording the possibility of effecting an extremely fast release.

Yet another object of this invention is to provide a device which can be so arranged as to be actuated both from one side of the boot, and from the rear and front, according to contingent requirements and individual user's preference.

These and other objects, such as will be apparent hereinafter, are achieved by a device for controlling the fitting-on of ski boots and the like, characterized in that it comprises a pressure band engageable with the front upper area of the foot, said pressure band being attached, with one end, to a side region of a boot, and connected with the other end to a tension band, said tension band being acted upon by releasable locking means, said tension band being actuatable by a skiing stick.

BRIEF DESCRIPTION OF THE DRAWINGS

Further features and advantages will be more clearly apparent from the following description of a preferred, though not limitative, embodiment of this device for controlling the fit of ski boots and the like, according to the invention, with reference to the accompanying exemplary drawings, where.

DESCRIPTION OF THE PREFERRED EMBODIMENTS

Figure 2:
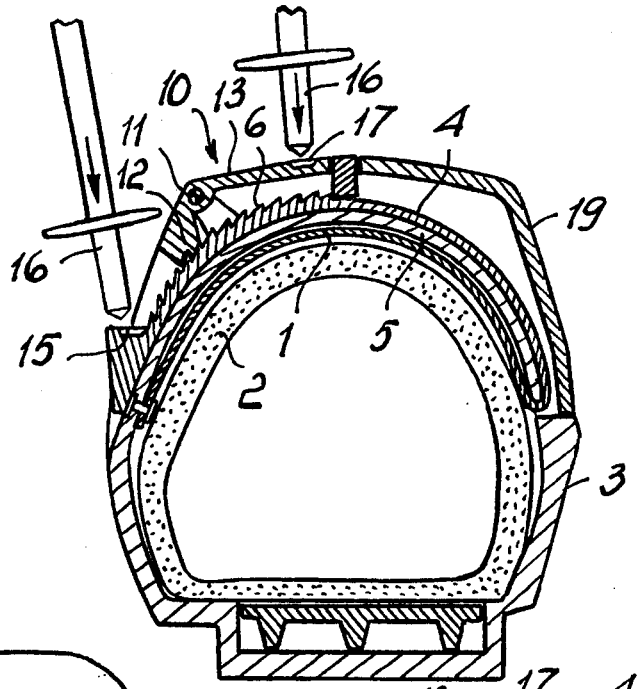
FIG. 2 is a cross sectional view of the boot with this device in the opened position.
Figure 3:
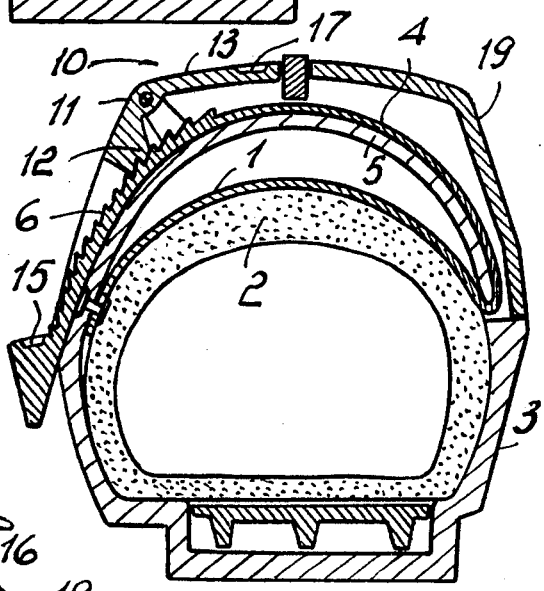
FIG. 3 is a cross-sectional view of the boot showing the device in its closed position.
Figure 1:
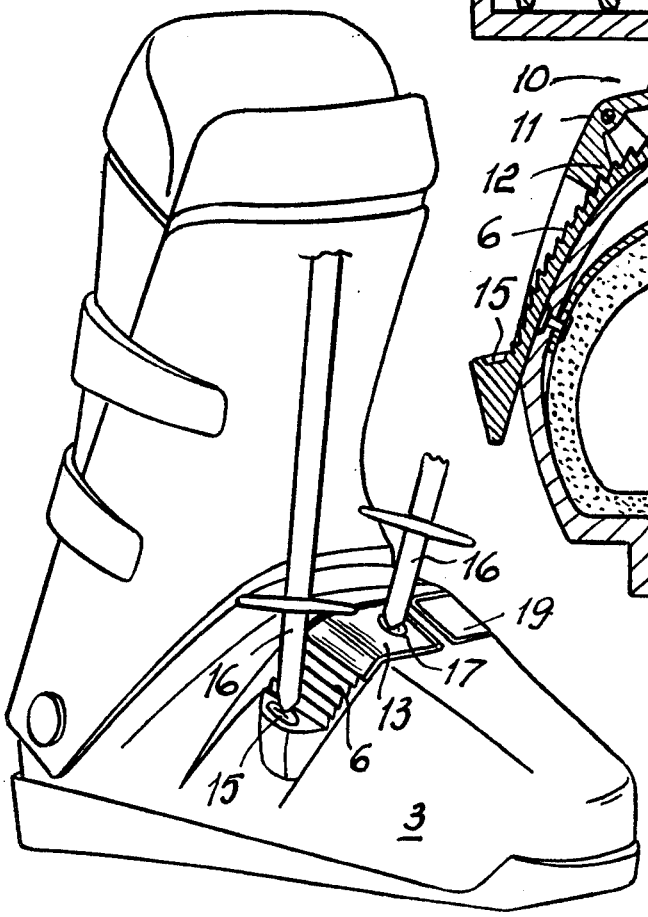
FIG. 1 shows schematically and in perspective a ski boot incorporating the device of this invention.

With reference to the drawing figures, and in particular to FIGS. 1 to 3, the device for controlling the fit of ski boots comprises a pressure band, indicated at 1, which is arranged at the middle front portion of the boot, above the inner shoe 2 normally provided on the interior of the outer shell 3 of a ski boot.

The cited pressure band 1 is secured, with one end, to a side portion of the shell 3 of the boot, preferably at the outside of the shell.

Said pressure band 1 is continued into a tension band 4 which extends above the pressure band 1 on a wing-like portion 5 of the shell which overlies the pressure band 1 and inner shoe 2 and is substantially rigid. As clearly visible in FIGS. 2 and 3, a continuous connecting portion of the bands 1 and 4 extends about the free end of the wing-like portion 5.

Proximate to its free end, the tension band 4 has, at the top, a serrated length 6, having saw tooth configured teeth which can be releasably engaged with a locking means, advantageously including a pawl element 10 including a lever element 11 mounted for oscillation and provided with a pawl portion 12 which has a serration allowing the band 4 to slide thereunder in the pulling direction, while preventing the sliding in the opposite direction.

The lever 11 has an opening wing or flange 13, opposedly located to the pawl portion 12 which, when depressed, causes the pawl portion 12 to disengage from the serration 6 on the band 4.

At its free end, the tension band 4 has an invitation recess 15, wherein can be engaged the tip of a skiing stick 16 in order to operate the device in the closing mode.

With particular reference to FIG. 2, it occurs that, with the device in the opened position, after fitting the boot onto the foot, it is possible to apply a tension onto the band 4 through the stick 16, which enables the skier, while maintining his/her standing station, to exert the desired compression force on the foot to thereby control its fit.

The compressive force as shown in FIG. 3, is due to the fact that the tension applied through the band 4 practically shortens the useful length of the pressure band 1, thus squeezing in practice the front portion of the inner shoe 2 against the foot with distributed forces which are all directed toward the foot central portion.

To release the fit control device, viz. to open the device, it will be sufficient to act, again by means of the stick 16, onto the wing of flange 13, which is advantageously formed with an invitation recess 17, thereby the pawl portion 12 is disengaged from the serration 6, which results in the inner shoe 2 being allowed to return into its initial position (FIG. 2), whereat it exerts no pressure action onto the foot.

For completeness sake, it should be added that on the inboard side of the boot, at the area thereof affected by the band 1 and band 4, there is provided a covering element 19 which has the function of preventing snow or water from leaking past the passage slit of the bands 1 and 4 left between the portion 5 and lower portion of the shell 3.

Figure 4:
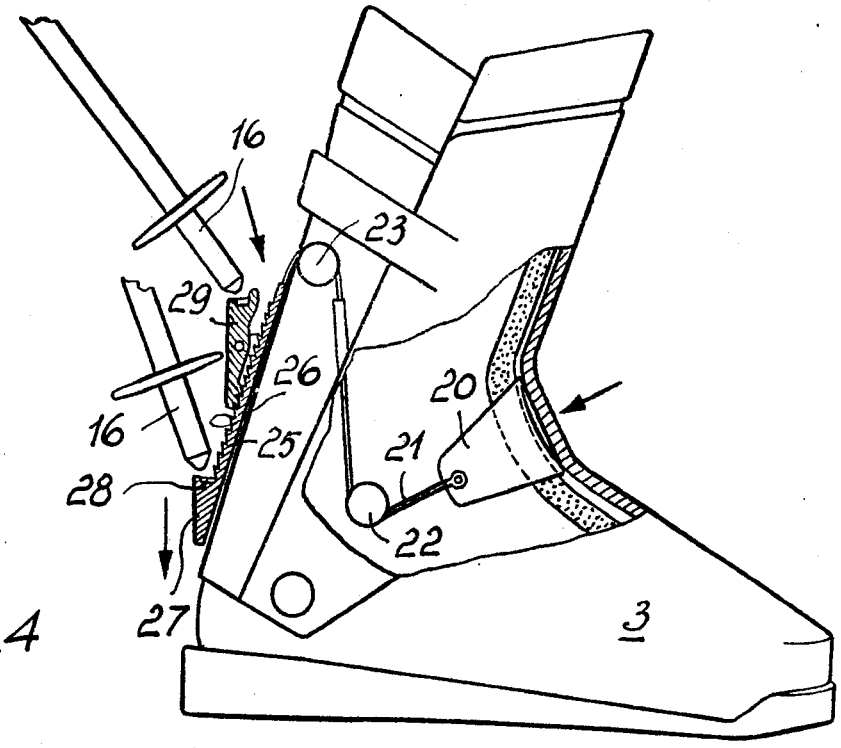
FIG. 4 shows a ski boot, partly in exploded view, wherein the device can be operated from the rear.

With reference to FIG. 4, the pressure band, as indicated at 20, which is always arranged at the middle front upper region of the foot and attached with one end to a side portion of the boot, is connected to a rope 21 which is run over a first return pulley 22 located laterally to the boot at the area of the ankle, and over a second return pulley 23 arranged rearwardly.

With the other end of the rope 21, there is connected a tension band, indicated at 25, which is formed on the outer face thereof with a serrated region 26 similar to the former and being terminated with a lug 27 having an invitation 28 for engagement with a skiing stick.

Also in this case, at the rearward portion, there is provided a releasable locking lever, indicated at 29 and quite similar in principle to the lever 11.

To operate the device, and similarly to the foregoing description, a pulling action is effected through the stick 16 by inserting the latter into the invitation 28, with the sole exception that the tension band is here positioned at, and accessible from, the rearward portion of the boot.

Figure 5:
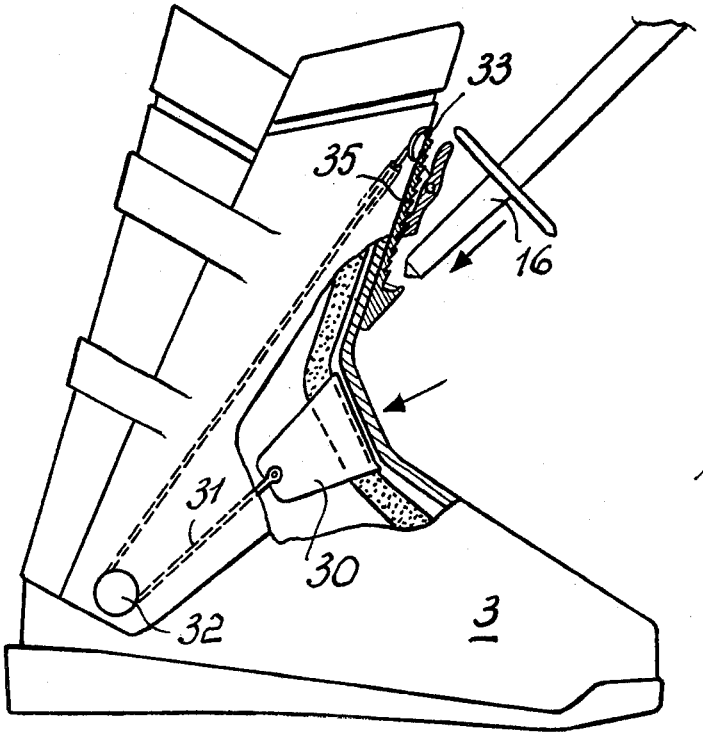
FIG. 5 is a partly exploded view of a ski boot, wherein the device can be operated from the front.

With reference to FIG. 5, there is illustrated an embodiment wherein the pressure band, indicated at 30, is connected with its free end to a cable 31 run over a first pulley 32 located at the lower side portion of the boot and over a second pulley 33 provided at the upper front portion of the boot.

To the cable 31, there is connected a tension band 35 similar to the previously described one.

Also in this case the device is operated using the same procedure as described hereinabove, with the exception that it is accessible from the upper front region of the boot.

It will be appreciated from the foregoing that the invention achieves its objects, and in particular that a pressure band is provided which enables the foot to be locked at the neck region, thus affording the possibility of an extremely convenient operation to be carried out through the skiing stick, hence with the skier in an upstanding attitude.

A further advantage is that the attitude of the skier and utilization of the stick enable the application of greater forces onto the pressure band without requiring an excessive effort by the user.

It should be further noted that the expedients just described afford the possibility of positioning the area of actuation of the device either rearwardly or frontly of the ski boot.

The materials employed, which are preferably the same materials as traditionally employed in manufacturing ski boots, as well as the dimensions and contingent shapes, may be any selected ones for the intended application.

I claim:

1. A device for controlling the fitting-on of ski boots and the like, comprising a pressure band extending transverse to the boot at a middle front portion thereof and having one end secured to the boot at a side portion thereof, a tension band extending above said pressure band and having one end connected to another end of said pressure band, and releasable locking means for operation on another end of said tension band to tension said pressure band, said tension band being actuatable by a skiing stick, wherein said releasable locking means comprises a substantially saw-tooth serration formed at said another end of said tension band and an oscillating lever element supported by the boot and having a pawl portion at one end for engaging said serration, said pawl portion having a serration enabling a translation of said tension band in a pulling direction and preventing a translation thereof in an opposite direction.

2. A device according to claim 1, wherein said lever element has an opening wing opposite to said pawl portion, whereby pressure on said opening wing allows disengagement of said pawl portion from said serration.

3. A device according to claim 1, wherein said pressure band is arranged on a portion of an inner shoe of the boot and said tension band is arranged on a substantially rigid wing-like portion of an outer shell of the boot overlying said pressure band, a continuous connecting portion of said bands extending about a free end of said wing-like portion whereby tensioning of said tension band causes tensioning of said pressure band and compressing of said portion of said inner shoe toward the inside of said inner shoe.

4. A device for controlling the fitting-on of ski boots and the like, comprising a pressure band extending transverse to the boot at a middle front portion thereof and having one end secured to the boot at a side portion thereof, a tension band for tensioning said pressure band, means for connecting one end of said tension band with another end of said pressure band, and releasable locking means for operation on another end of said tension band to tension said pressure band, said tension band being actuatable by a skiing stick, wherein said releasable locking means comprises a substantially saw-tooth serration formed at said another end of said tension band and an oscillating lever element supported by the boot and having a pawl portion at one end for engaging said serration, said pawl portion having a serration enabling a translation of said tension band in a pulling direction and preventing a translation thereof in an opposite direction, and wherein said means for connecting one end of said tension band with another end of said pressure band comprise a rope run over a first pulley provided on a side portion of the boot at the ankle region, and over a second pulley provided at a rearward portion of the boot, said tension band being accessible from said rearward portion of the boot.

5. A device for controlling the fitting-on of ski boots and the like, comprising a pressure band extending transverse to the boot at a middle front portion thereof and having one end secured to the boot at a side portion thereof, a tension band for tensioning said pressure band, means for connecting one end of said tension band with another end of said pressure band, and releasable locking means for operation on another end of said tension band to tension said pressure band, said tension band being actuatable by a skiing stick, wherein said releasable locking means comprises a substantially saw-tooth serration formed at said another end of said tension band and an oscillating lever element supported by the boot and having a pawl portion at one end for engaging said serration, said pawl portion having a serration enabling a translation of said tension band in a pulling direction and preventing a translation thereof in an opposite direction, and wherein said means for connecting one end of said tension band with another end of said pressure band comprise a cable run over a first pulley provided at a lower side area of the boot over a second pulley provided at an upper front portion of the boot, said tension band being actuatable from said upper front portion of the boot.

* * * * *